US007401876B2

(12) United States Patent
Sekiguchi

(10) Patent No.: US 7,401,876 B2
(45) Date of Patent: Jul. 22, 2008

(54) INK JET PRINTER AND INK DISCHARGING METHOD OF THE INK JET PRINTER

(75) Inventor: Yasuhiro Sekiguchi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 403 days.

(21) Appl. No.: 11/135,877

(22) Filed: May 24, 2005

(65) Prior Publication Data

US 2005/0259124 A1 Nov. 24, 2005

(30) Foreign Application Priority Data

May 24, 2004 (JP) ..... 2004-153612

(51) Int. Cl.
*B41J 29/38* (2006.01)

(52) U.S. Cl. ..... 347/14; 347/17

(58) Field of Classification Search ..... 347/11, 347/14, 17

See application file for complete search history.

(56) References Cited

U.S. PATENT DOCUMENTS

| | | | |
|---|---|---|---|
| 5,736,994 | A | 4/1998 | Takahashi |
| 6,141,113 | A | 10/2000 | Takahashi |
| 6,254,213 | B1 | 7/2001 | Ishikawa |
| 6,412,925 | B1 | 7/2002 | Takahashi |
| 6,488,349 | B1 | 12/2002 | Matsuo et al. |
| 6,523,923 | B2 | 2/2003 | Sekiguchi |
| 6,575,544 | B2 * | 6/2003 | Iriguchi ..... 347/11 |
| 2003/0146956 | A1 | 8/2003 | Takahashi |
| 2004/0090476 | A1 | 5/2004 | Sekiguchi |
| 2004/0207671 | A1 | 10/2004 | Kusunoki et al. |
| 2004/0246315 | A1 | 12/2004 | Takahashi |
| 2005/0259124 | A1 | 11/2005 | Sekiguchi |

FOREIGN PATENT DOCUMENTS

| | | |
|---|---|---|
| EP | 0775579 | 5/1997 |
| JP | 7178894 | 7/1995 |
| JP | 2002137390 | 5/2002 |
| JP | 2003080707 | 3/2003 |
| JP | 2003136690 | 5/2003 |
| WO | WO 2005/000589 | 1/2005 |

OTHER PUBLICATIONS

U.S. Appl. No. 11/276,316.

* cited by examiner

*Primary Examiner*—Thinh H Nguyen
(74) *Attorney, Agent, or Firm*—Reed Smith LLP

(57) ABSTRACT

An ink jet printer for high quality printing comprises an ink chamber, a nozzle connected with the ink chamber, a pressure chamber located between the ink chamber and the nozzle, a piezoelectric element facing the pressure chamber, a temperature sensor for measuring at least one of a temperature of ink and a surrounding temperature of the ink jet printer, and a controller. The controller is programmed to perform a first change of voltage applied to the piezoelectric element and a second change of voltage applied to the piezoelectric element. Furthermore, the controller is programmed to change a period between the first change and the second change based on the temperature measured by the temperature sensor.

16 Claims, 12 Drawing Sheets

FIG. 11

| Ta, Wa | 0.5AL | 0.6AL | 0.7AL | 0.8AL | 0.9AL | 1.0AL | 1.1AL | 1.2AL | 1.3AL | 1.4AL | 1.5AL |
|---|---|---|---|---|---|---|---|---|---|---|---|
| 10℃ | × | × | × | △ | △ | ○ | ○ | ○ | ○ | △ | △ |
| 25℃ | × | × | △ | △ | ○ | ○ | ○ | △ | × | × | × |
| 40℃ | × | △ | ○ | ○ | △ | × | × | △ | △ | × | × |

INK JET PRINTER AND INK DISCHARGING METHOD OF THE INK JET PRINTER

CROSS-REFERENCE TO RELATED APPLICATION

This application claims priority to Japanese Patent Application No. 2004-153612 filed on May 24, 2004, the contents of which are hereby incorporated by reference into the present application.

BACKGROUND OF THE INVENTION

1. Field of the Invention

The present invention relates to an ink jet printer. The present invention further relates to a method of discharging ink from the ink jet printer.

2. Description of the Related Art

Ink jet printers are widely known. Ink jet printer generally comprises an ink chamber, a pressure chamber, a nozzle, an actuator and a controller. The ink chamber stores ink. The pressure amber is connected with the ink chamber. The nozzle is connected with the pressure chamber. The actuator generally has a piezoelectric element. The piezoelectric element is disposed in the vicinity of the pressure chamber. Volume of the pressure chamber changes when the piezoelectric element is deformed due to piezoelectric effects. The controller controls the actuator by changing voltage applied to the piezoelectric element.

The controller changes the voltage applied to the piezoelectric element in order to discharge ink. The controller changes the voltage applied to the piezoelectric element such that the pressure in the pressure chamber is reduced. That is, the controller changes the shape of the piezoelectric element such that the volume of the pressure chamber increases. As a result, the ink moves from the ink chamber to the pressure chamber. Thereupon, the controller changes the voltage applied to the piezoelectric element such that the volume of the pressure chamber is increased. That is, the controller changes the shape of the piezoelectric element such that the volume of the pressure chamber decreases. By this means, pressure is applied to the ink that has been filled within the pressure chamber, and the ink is discharged from the nozzle.

When the time or period between the reduction and the subsequent increase of pressure in the pressure chamber is changed, there is a change in the quantity of ink discharged from the nozzle. Printing density changes when there is a change in the quantity of ink discharged. An important factor in stabilizing printing density is to control the time or period that elapses between the reduction and the subsequent increase of pressure in the pressure chamber.

Japanese Patent Application Publication No. 2003-145750 (U.S. Pat. No. 6,523,923) discloses a technique for determining the time between the reduction and the subsequent increase of pressure in the pressure chamber. In this technique, the period for a pressure wave developed within the ink to propagate from the ink chamber to the nozzle (below, this period will be termed a one-way propagation period) is used as an index, and the time between the reduction and the subsequent increase of pressure in the pressure chamber is determined using this index. If the time between the reduction and the subsequent increase of pressure in the pressure chamber is identical with the one-way propagation period, the actuator can efficiently decrease and increase the pressure of the ink. That is, considerable pressure change can be applied to the ink in the pressure chamber. When pressure change is applied efficiently to the ink, the ink can be discharged efficiently.

BRIEF SUMMARY OF THE INVENTION

Ink viscosity changes as the temperature of the ink changes. Viscosity decreases when the ink temperature is high, and increases when the ink temperature is low. When the ink viscosity changes, there is a change in the speed at which the pressure wave propagates through the ink. That is, its propagation speed is faster when the ink viscosity is low, and is slower when the ink viscosity is high.

In the conventional technique described above, the time or period between a change (first change) of voltage applied to the piezoelectric element and a subsequent change (second change) of voltage applied to the piezoelectric element is fixed within a range close to a one-way propagation period of ink being at a certain temperature. If the temperature of the ink increases or decreases, the propagation speed of the pressure wave changes, and consequently the second change is performed at a time that diverges from the one-way propagation period at the certain temperature. If the time between the first change and the second change is a fixed period, printing density changes when the temperature of the ink changes. With the conventional technique, printing density cannot be stabilized when the temperature of the ink changes.

The technique disclosed in the present specification was invented to solve the above problem, and an ink jet printer is realized in which printing density can be stabilized even when the temperature of ink changes.

An ink jet printer invented by the present inventor comprises a sensor for measuring at least one of a temperature of ink and a surrounding temperature of the ink jet printer. A controller is programmed to perform a first change of voltage applied to the piezoelectric element and a second change of voltage applied to the piezoelectric element. The controller is programmed to change a period between the first change and the second change based on the temperature measured by the temperature sensor.

When the ink temperature changes, in accordance with this change, the period between the first change and the second change is adjusted. An ink jet printer can be realized in which printing density is optimal irrespective of the temperature of the ink.

BRIEF DESCRIPTION OF THE DRAWINGS

FIG. 10 (*b*) shows pulse signals for discharging generated by a pulse generator.

FIG. 11 shows test results concerning the relation between printing density and pulse width of the pulse signals. Test results are shown for differing ink temperatures.

DETAILED DESCRIPTION OF THE INVENTION

Figure 1:
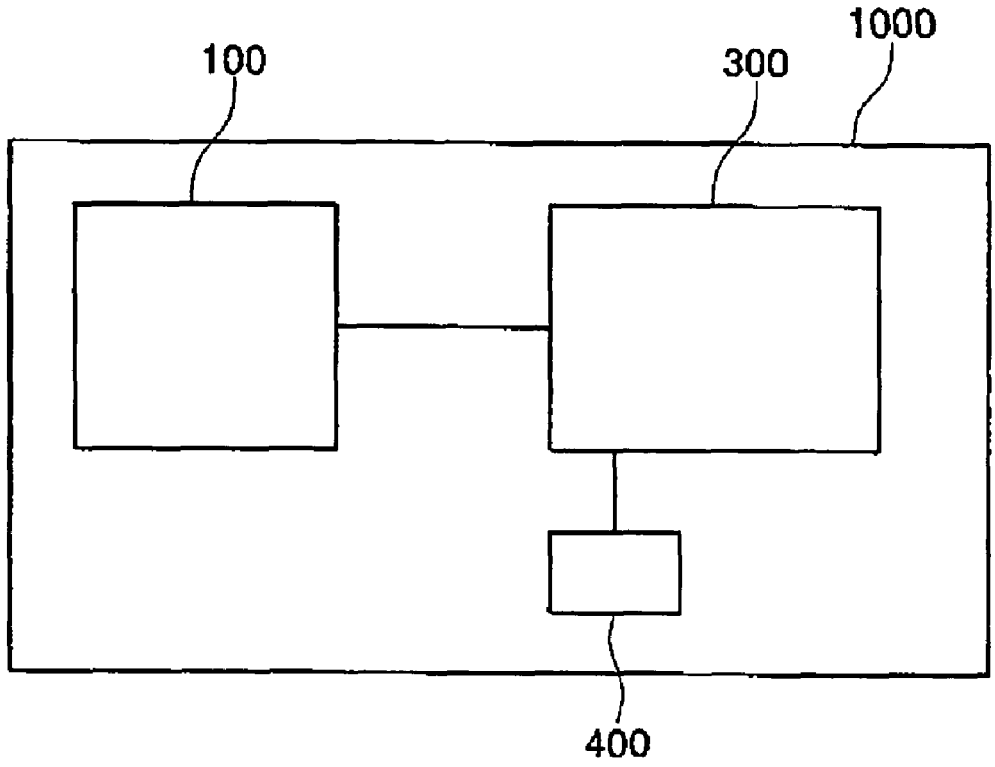
FIG. 1 schematically shows a configuration of an ink jet printer of the present embodiment.

A preferred embodiment of the present technique will now be described with reference to the drawings. FIG. 1 schematically shows a configuration of an ink jet printer 1000 of the present embodiment. The ink jet printer 1000 comprises an ink jet head 100, a controller 300, a temperature sensor 400, etc. The ink jet head 100 is a piezoelectric ink jet head. The ink jet head 100 performs printing on a medium such as paper or the like by discharging ink from a plurality of nozzles (not shown in FIG. 1) located at its lower face. The controller 300 controls the operation of the ink jet head 100. The temperature sensor 400 measures the temperature of the location where the ink jet printer 1000 is disposed.

Figure 2:
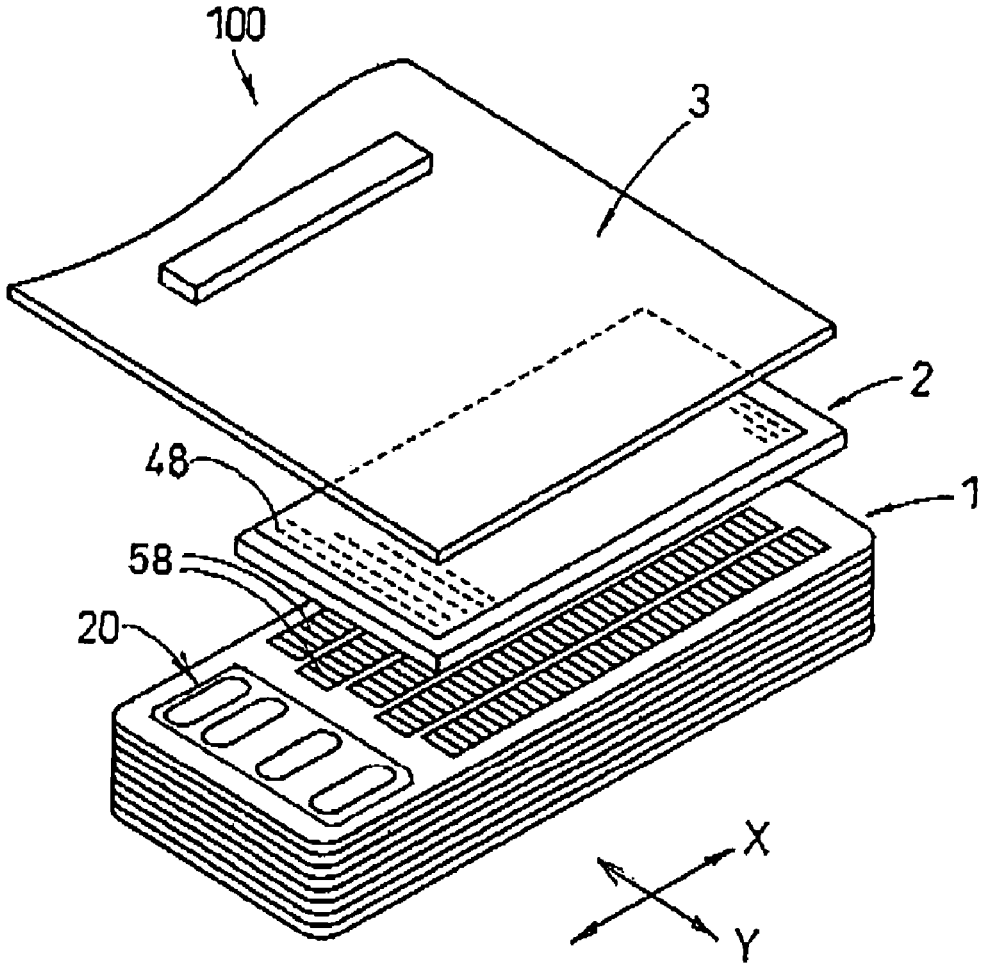
FIG. 2 shows a perspective view of an ink jet head of the ink jet printer.

FIG. 2 is an exploded perspective view of the piezoelectric ink jet head 100. The ink jet head 100 is mounted on a carriage (not shown) capable of moving in a direction (an X direction) orthogonal to a delivery direction of the paper (a Y direction). When the paper to be printed is delivered in the Y direction, the entire range of the paper can be printed by moving the carriage in the X direction. Cyan, magenta, yellow, and black ink cartridges are directly or indirectly connected with the ink jet head 100.

The ink jet head 100 comprises a cavity unit 1, an actuator unit 2, a flat cable 3, etc. The cavity unit 1 is formed from a plurality of metal plates, etc. A detailed description of the configuration of the cavity unit 1 will be given later. The actuator unit 2 is connected with an upper face of the cavity unit 1. The actuator unit 2 is formed from a plurality of piezoelectric sheets, etc. A detailed description of the configuration of the actuator unit 2 will be given later. The flat cable 3 is connected with an upper face of the actuator unit 2. Power from a printer main body is supplied to the actuator unit 2 via the flat cable 3.

Figure 3:
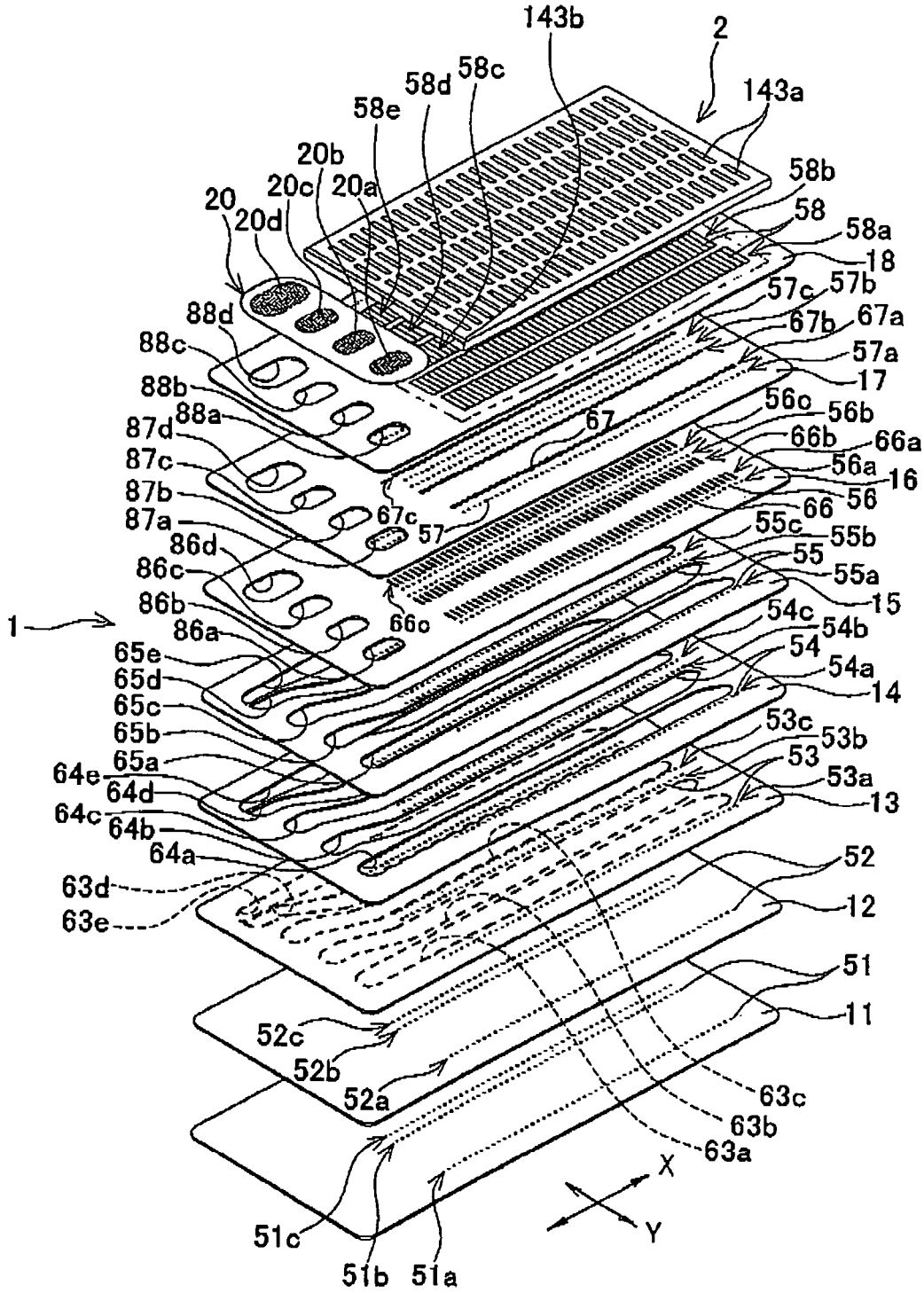
FIG. 3 shows an exploded perspective view of a cavity unit.

Next, a detailed description of the configuration of the cavity unit 1 will be given with reference to FIG. 3. FIG. 3 is an exploded perspective view of the cavity unit 1. Further, FIG. 3 also shows the actuator unit 2 connected with the upper face of the cavity unit 1.

As is clear from FIG. 3, the cavity unit 1 comprises eight thin plates bonded together by adhesive. These comprise, in sequence from below, a nozzle plate 11, a spacer plate 12, a damper plate 13, a first manifold plate 14, a second manifold plate 15, a supply plate 16, a base plate 17, and a cavity plate 18. In the present embodiment, each of the plates 11 to 18 has a thickness of approximately 50 to 150 (μm). The nozzle plate 11 is formed from synthetic resin such as polyimide, etc. The remaining plates 12 to 18 are formed from 42% nickel alloy steel plates.

The nozzle plate 11 has rows of nozzles 51*a*, 51*b*, 51*c*, 51*d*, and 51*e* formed from nozzles 51 that have an extremely small diameter (approximately 25 (μm) in this embodiment) and are aligned in the X direction. In FIG. 3, a reference number has not been applied to all the nozzles 51. However, each of the small points shown on an upper side of the nozzle plate 11 is a nozzle 51. The nozzles 51 are holes that pass through the nozzle plate 11 in its direction of thickness, and which grow smaller in diameter towards their lower side.

Moreover, only the rows of nozzles 51*a*, 51*b*, and 51*c* are shown in FIG. 3. However, the nozzle plate 11 actually has five rows of nozzles. Although this is not shown, a row of nozzles adjacent to the row of nozzles 51*c*—this being opposite the row of nozzles 51*b*—is represented by the number 51*d*, and a row of nozzles adjacent to the row of nozzles 51*d* is represented by the number 51*e*. The rows of nozzles 51*a* to 51*e* are parallel in the Y direction. A relatively large space is formed between the row of nozzles 51*a* and the row of nozzles 51*b*. By contrast, there is a small space between the rows of nozzles 51*b* and 51*c*. There is again a large space between the rows of nozzles 51*c* and 51*d*, and there is a small space between the rows of nozzles 51*d* and 51*e*.

Each of the rows of nozzles 51*a* to 51*e* has a length in the X direction of one inch, and each row of nozzles has 75 nozzles. In the present embodiment, array density of the nozzles 51 is 75 dpi (dots per inch).

As will be described later, the row of nozzles 51*a* discharges cyan ink, the row of nozzles 51*b* discharges yellow ink, the row of nozzles 51*c* discharges magenta ink, and the row of nozzles 51*d* and 51*e* discharges black ink.

The spacer plate 12 is connected with an upper face of the nozzle plate 11. As shown in FIG. 3, the spacer plate 12 has rows of spacer plate holes (referred to hereafter as rows of SP holes) 52*a*, 52*b*, 52*c*, 52*d*, and 52*e* formed from SP holes 52 that have an extremely small diameter and are aligned in the X direction (52*d* and 52*e* are not shown). In FIG. 3, a reference number has not been applied to all the SP holes 52. However, each of the small points shown on an upper side of the spacer plate 12 is an SP hole 52. The SP holes 52 are holes that pass through the spacer plate 12 in its direction of thickness. The diameter of the SP holes 52 is constant along this direction of thickness, and this diameter is identical with the diameter of an upper end of the nozzles 51.

Moreover, only the rows of SP holes 52*a*, 52*b*, and 52*c* are shown in FIG. 3. However, the spacer plate 12 actually has five rows of SP holes. Although this is not shown, a row of SP holes adjacent to the row of SP holes 52*c*—this being opposite the row of SP holes 52*b*—is represented by the number 52*d*, and a row of SP holes adjacent to the row of SP holes 52*d* is represented by the number 52*e*. The rows of SP holes 52*a* to 52*e* are parallel in the Y direction.

In the case where the spacer plate 12 is overlapped with the nozzle plate 11, the nozzles 51 and the SP holes 52 are in a uniform location.

The damper plate 13 is connected with an upper face of the spacer plate 12. As shown in FIG. 3, the damper plate 13 has rows of damper plate holes (referred to hereafter as rows of DP holes) 53*a*, 53*b*, 53*c*, 53*d*, and 53*e* aligned in the X direction (in FIG. 3, a reference number has not been applied to the DP holes 53*d* and 53*e*). These rows of DP holes are formed from DP holes 53 with an extremely small diameter. In FIG. 3, a reference number has not been applied to all the DP holes 53. However, each of the small points shown on an upper side of the damper plate 13 is a DP hole 53. The DP holes 53 are holes that pass through the damper plate 13 in its direction of thickness. The diameter of the DP holes 53 is constant along this direction of thickness, and this diameter is identical with the diameter of the SP holes 52 (that is, with the diameter of the upper end of the nozzles 51).

In the case where the damper plate 13 is overlapped with the spacer plate 12, the DP holes 53 and the SP holes 52 are in a uniform location.

Five grooves 63*a*, 63*b*, 63*c*, 63*d*, and 63*e*, each having a base, are formed in a lower face of the damper plate 13. Each of the grooves 63*a* to 63*e* extends in the X direction. The grooves 63*a* to 63*e* are mutually parallel in the Y direction. Each of the grooves 63*a* to 63*e* has a constant depth. The grooves 63*a* and 63*b* are formed between the rows of DP holes 53*a* and 53*b*. The grooves 63*c* and 63*d* are formed between the rows of DP holes 53*c* and 53*d*. The groove 63*e* is located in the vicinity of the DP hole 53*e*. The damper plate 13 is thinner, in the locations with the grooves 63*a* to 63*e*, by the depth of these grooves 63*a* to 63*e*. This allows the damper plate 13 to easily bend upwards or downwards. Pressure applied to an ink chamber 120 (to be described) can thus be absorbed, and the operation of the damper can thus be realized.

The first manifold plate 14 is connected with an upper face of the damper plate 13. The first manifold plate 14 has rows of first manifold plate holes (referred to hereafter as rows of first MP holes) 54*a*, 54*b*, 54*c*, 54*d*, and 54*e* formed from first MP holes 54 that have an extremely small diameter and are aligned in the X direction (in FIG. 3, a reference number has not been applied to 54*d* and 54*e*). In FIG. 3, a reference number has not been applied to all the first MP holes 54. However, each of the small points shown on the first manifold plate 14 is a first MP hole 54. The first MP holes 54 are holes that pass through the first manifold plate 14 in its direction of thickness. The diameter of the first MP holes 54 is constant along this direction of thickness, and is identical with the diameter of the DP holes 53 (that is, with the diameter of the upper end of the nozzles 51).

In the case where the first manifold plate 14 is overlapped with the damper plate 13, the first MP holes 54 and the DP holes 53 at in a uniform location.

Further, five long holes 64*a*, 64*b*, 64*c*, 64*d*, and 64*e* are formed in the first manifold plate 14. Each of the long holes 64*a* to 64*e* extends in the X direction The long holes 64*a* to 64*e* are mutually parallel in the Y direction. Each of the long holes 64*a* to 64*e* passes through the first manifold plate 14 in its direction of thickness. The shape of the long hole 64*a* in the XY direction is identical with the shape of the groove 63*a* of the damper plate 13 in the XY direction. Similarly, the shape of the long holes 64*b* to 63*e* in the XY direction is identical with the shape of the grooves 63*b* to 63*e* of the damper plate 13 in the XY direction. When the first manifold plate 14 is overlapped with the damper plate 13, the grooves 63*a* to 63*e* of the damper plate 13 and the long holes 64*a* to 64*e* of the first manifold plate 14 are in a uniform location.

The second manifold plate 15 is connected with an upper face of the first manifold plate 14. The second manifold plate 15 has a shape identical with the shape of the first manifold plate 14. That is, the second manifold plate 15 has rows of second manifold plate holes (referred to hereafter as rows of second MP holes) 55*a* to 55*e* (in FIG. 3, a reference number has not been applied to 55*d* and 55*e*), and has five long holes 65*a* to 65*e*. Since the configuration of the first manifold plate 14 has been described in detail, a detailed description of the second manifold plate 15 will be omitted.

Figure 8:
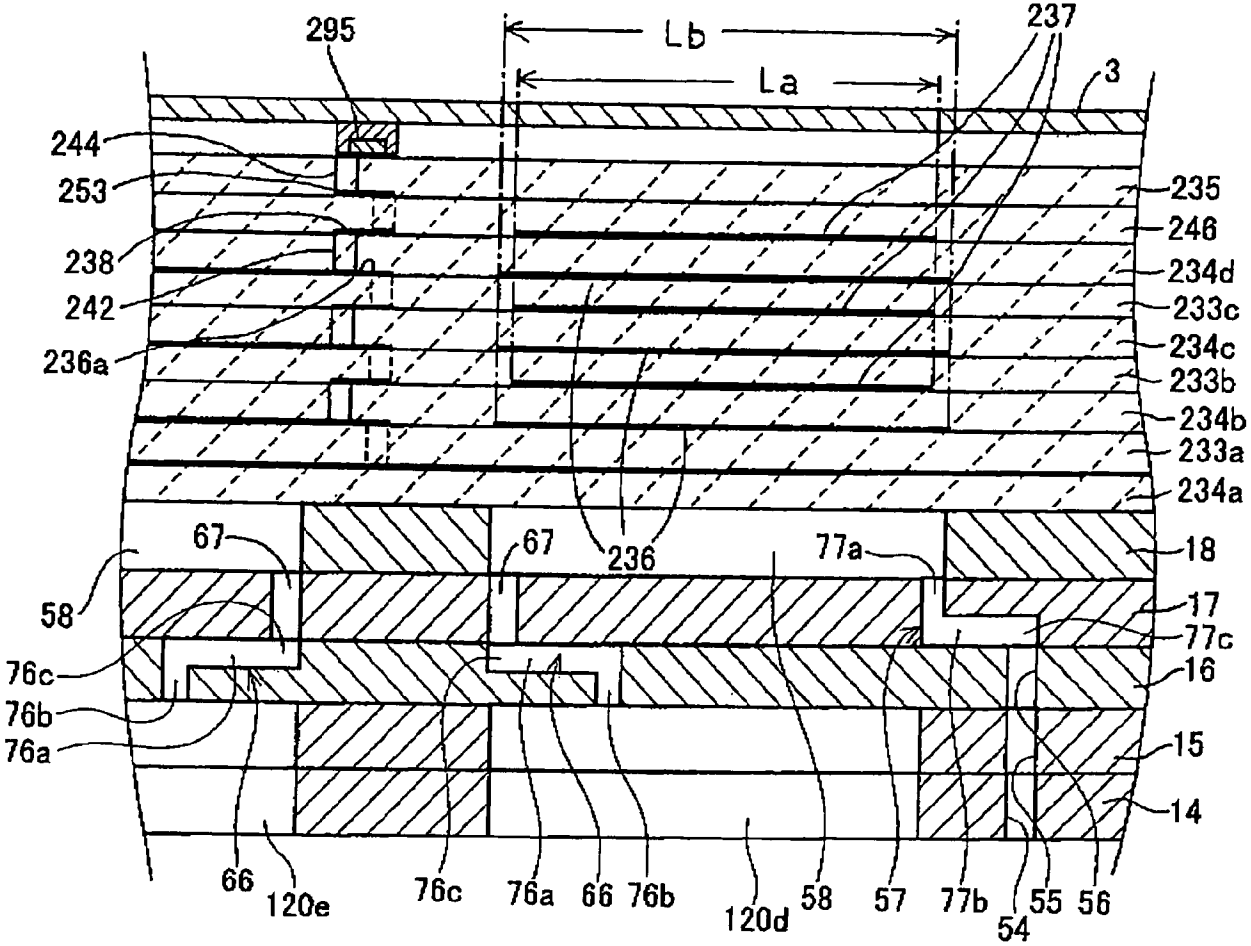
FIG. 8 shows a cross-sectional view along the line VIII-VIII of FIG. 6.

FIG. 8 shows the first manifold plate 14 and the second manifold plate 15 in a connected state. When the first manifold plate 14 and the second manifold plate 15 are connected, the long holes 64*a* to 64*e* and the long holes 65*a* to 65*e* overlap to form five large cavities 120*a*, 120*b*, 120*c*, 120*d*, and 120*e* (in FIG. 8, only the two cavities 120*d* and 120*e* are shown). That is, the cavity 120*a* (not shown) is formed from the long hole 64*a* and the long hole 65*a*. The cavity 120*b* (not shown) is formed from the long hole 64*b* and the long hole 65*b*. The cavity 120*c* (not shown) is formed from the long hole 64*c* and the long hole 65*c*. The cavity 120*d* is formed from the long hole 64*d* and the long hole 65*d*, and the cavity 120*e* is formed from the long hole 64*e* and the long hole 65*e*. These cavities 120*a* to 120*e* form chambers enclosed by the upper face of the damper plate 13 and a lower face of the supply plate 16 (described next). The chambers 120*a* to 120*e* function as ink chambers for storing the ink. Cyan ink is stored in the ink chamber 120*a*. Yellow ink is stored in the ink chamber 120*b*. Magenta ink is stored in the ink chamber 120*c*. Black ink is stored in the ink chamber 120*d* and the ink chamber 120*e*. The two ink chambers 120*d* and 120*e* are used for black ink because black ink is used more than ink of other colors.

The supply plate 16 is connected with an upper face of the second manifold plate 15 (see FIG. 3). The supply plate 16 has rows of supply plate holes (referred to hereafter as rows of SL holes) 56*a*, 56*b*, 56*c*, 56*d*, and 56*e* formed from SL holes 56 that have an extremely small diameter and are aligned in the X direction (in FIG. 3, a reference number has not been applied to 56*d* and 56*e*). In FIG. 3, a reference number has not been applied to all the SL holes 56. However, each of the small points shown on the supply plate 16 is an SL hole 56. The SL holes 56 are holes that pass through the supply plate 16 in its direction of thickness. The diameter of the SL holes 56 is constant along this direction of thickness, and is identical with the diameter of the second MP holes 55 (that is, with the diameter of the upper end of the nozzles 51).

In the case where the supply plate 16 is overlapped with the second manifold plate 15, the SL holes 56 and the second MP holes 55 are in a uniform location.

Figure 4:
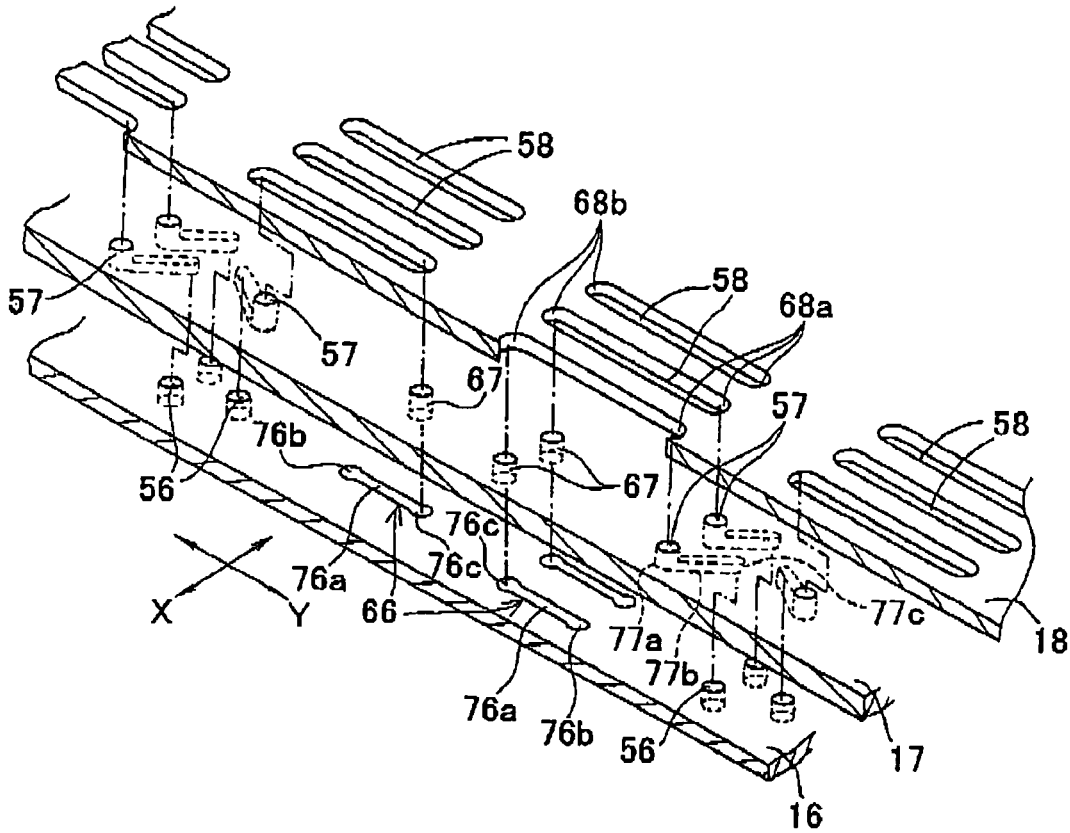
FIG. 4 shows a perspective view displaying an exploded view of a portion of the cavity unit.

Further, rows of SL long holes 66*a*, 66*b*, 66*c*, 66*d*, and 66*e*—these being formed from small long holes 66 that are aligned in the X direction—are formed in the supply plate 16. Only the rows of SL long holes 66*a*, 66*b*, and 66*c* are shown in FIG. 3. However, the supply plate 16 actually has five rows of SL long holes. Although this is not shown, a row of SL long holes adjacent to the row of SL long boles 66*c* is represented by the number 66*d*. A row of SL long holes adjacent to the row of SL long holes 66*d* is represented by the number 66*e*. The SL long holes 66*a* to 66*e* are mutually parallel in the Y direction. One SL long hole 66 is provided for one SL hole 56. As a result, there is an identical number of SL holes 56 and long holes 66. As shown in FIG. 4 and FIG. 8, each long hole 66 comprises: a grove 76*a* that has a base, the groove 76*a* being formed in the upper face of the supply plate 16 and extends in the Y direction; an intake hole 76*b* that connects with one end of the groove 76*a* and passes through the supply plate 16 in its direction of thickness; and a discharge hole 76*c* that connects with the other end of the groove 76*a*. As is clear from FIG. 4, the diameter of the intake hole 76*b* and the discharge hole 76*c* is greater than the width of the groove 76*a* when the supply plate 16 is viewed from the top. The intake hole 76*b* of each long hole 66 is connected with an ink chamber (any one of 120*a* to 120*e*). The groove 76*a* has the smallest cross-sectional area within an ink passage, and functions as a restrictor. The groove 76*a* has the smallest cross-sectional area within the ink passage, and separates the ink chamber 120 and pressure chamber 58 (to be described).

Furthermore, four ink supply holes 86*a*, 86*b*, 86*c*, and 86*d* are formed in the supply plate 16 (see FIG. 3). The ink supply holes 86*a*, 86*b*, 86*c*, and 86*d* are holes that pass through the supply plate 16 in its direction of thickness. The three ink supply holes 86*a*, 86*b*, and 86*c* have the same size. The ink supply hole 86*d* is somewhat larger than the other ink supply holes 86*a*, etc. The ink supply hole 86*a* connects with the ink chamber 120*a*. Similarly, the ink supply hole 86*b* connects with the ink chamber 120*b*, and the ink supply hole 86*c* connects with the ink chamber 120*c*. The ink supply hole 86*d* connects with the two ink chambers 120*d* and 120*e*.

The base plate 17 is connected with the upper face of the supply plate 16. As shown in FIG. 3, the base plate 17 has rows of first base plate holes 57*a*, 57*b*, 57*c*, 57*d*, and 57*e* (referred to hereafter as rows of first BP holes) formed from holes 57 that have an extremely small diameter and are aligned in the X direction (in FIG. 3, a reference number has not been applied to 57*d* and 57*e*). As is clear from FIGS. 4 and 8, the first BP holes 57 each comprise a part 77*a* that passes through the base plate 17 in its direction of thickness, and a groove part 77*b* that is joined with the part 77*a* and is formed at a lower face of the base plate 17.

In the case where the base plate 17 is overlapped with the supply plate 16, the SL holes 56 and one end 77*c* (an end at the opposite side from the part 77*a*) of each of the groove parts 77*b* of the first BP holes 57 are in a uniform location. The rows of BP holes 57*a* to 57*e* are mutually parallel in the Y direction.

Further, the base plate 17 has rows of second base plate holes 67*a*, 67*b*, 67*c*, 67*d*, and 67*e* (referred to hereafter as rows of second BP holes) that are formed from a plurality of holes 67 aligned in the X direction. Only three rows of second BP holes 67*a*, 67*b*, and 67*c* are shown in FIG. 3. However, the base plate 17 actually has five rows of second BP holes. Although this is not shown, a row of second BP holes adjacent to the row of second BP holes 67*c*—this being opposite the row of second BP holes 67*b*—is represented by the number 67*d*. A row of second BP holes adjacent to the row of second BP holes 67*d* is represented by the number 67*e*. As is clear from FIG. 4, the second BP holes 67 are holes that pass through the base plate 17 in its direction of thickness. The rows of second BP holes 57*a* to 57*e* are mutually parallel in the Y direction. One second BP hole 67 is provided for one first BP hole 57. As a result, there is an identical number of first BP holes 57 and second BP holes 67.

In the case where the base plate 17 is overlapped with the supply plate 16, the second BP holes 67 and the discharge holes 76*c* of the long holes 66 are in a uniform location (see FIG. 4).

Further, the base plate 17 has four ink supply holes 87*a*, 87*b*, 87*c*, and 87*d* (see FIG. 3). The ink supply holes 87*a*, 87*b*, 87*c*, and 87*d* pass through the base plate 17 in its direction of thickness. The three ink supply holes 87*a*, 87*b*, and 87*c* have the same size. The ink supply hole 87*d* is somewhat larger than the other ink supply holes 87*a*, etc. The ink supply hole 87*a* joins with the ink supply hole 86*a* of the supply plate 16. Similarly, the ink supply hole 87*b* joins with the ink supply hole 86*b*, the ink supply hole 87*c* joins with the ink supply hole 86*c*, and the ink supply hole 87*d* joins with the ink supply hole 86*d*.

The cavity plate 18 is connected with an upper face of the base plate 17. The cavity plate 18 has rows of long holes 58*a*, 58*b*, 58*c*, 58*d*, and 58*e*, each of these rows being formed from a plurality of long holes 58 aligned in the X direction. Each of long holes is extending in the Y direction. As is clear from FIG. 4, the long holes 58 are holes that pass through the cavity plate 18 in its direction of thickness. The long holes 58 of adjacent rows of long holes 58*a* to 58*e* are mutually displaced by half a pitch in the X direction. With the rows of long holes 58*a* and 58*b*, for example, the long holes 58 are mutually displaced by half a pitch in the X direction. That is, the long holes 58 are disposed in a zigzag shape.

As is clear from FIG. 4, in the case where the cavity plate 18 is overlapped with the base plate 17, the first BP holes 57 and an edge 68*a* of each long hole 58 are in a uniform location, and the second BP holes 67 and the other edge 68*b* of each long hole 58 are in a uniform location.

As shown in FIG. 8, the long holes 58 form chambers enclosed by the upper face of the base plate 17 and a lower face of the actuator unit 2. Each chamber 58 functions as a pressure chamber whose volume changes as the actuator unit 2 operates.

Further, the cavity plate 18 has four ink supply holes 88*a*, 88*b*, 88*c*, and 88*d* (see FIG. 3). The ink supply holes 88*a*, 88*b*, 88*c*, and 88*d* pass through the cavity plate 18 in its direction of thickness. The three ink supply holes 88*a*, 88*b*, and 88*c* have the same size. The ink supply hole 88*d* is somewhat larger than the other ink supply holes 88*a*, etc. The ink supply hole 88*a* joins with the ink supply hole 87*a* of the base plate 17. Similarly, the ink supply hole 88*b* joins with the ink supply hole 87*b*, the ink supply hole 88*c* joins with the ink supply hole 87*c*, and the ink supply hole 88*d* joins with the ink supply hole 87*d*.

A filter body 20 is bonded, using adhesive or the like, to an upper face of the cavity plate 18 (see FIG. 3). Filter parts 20*a*, 20*b*, 20*c*, and 20*d* of the filter body 20 correspond respectively to the ink supply holes 88*a*, 88*b*, 88*c*, and 88*d*. A cyan ink cartridge (not shown) is connected with the filter part 20*a* of the filter body 20. The cyan ink is filled into the ink chamber 120*a* via the filter part 20*a*. Further, a yellow ink cartridge (not shown) is connected with the filter part 20*b*. A magenta ink cartridge (not shown) is connected with the filter part 20*c*, and a black ink cartridge (not shown) is connected with the filter part 20*d*.

The length of an ink passage from the ink chamber 120 to the pressure chamber 58 is approximately the same length as an ink passage from the pressure chamber 58 to the nozzle 51. The pressure chamber 58 is disposed at approximately the center of the ink passage extending between the ink chamber 120 and the nozzle 51.

Figure 5:
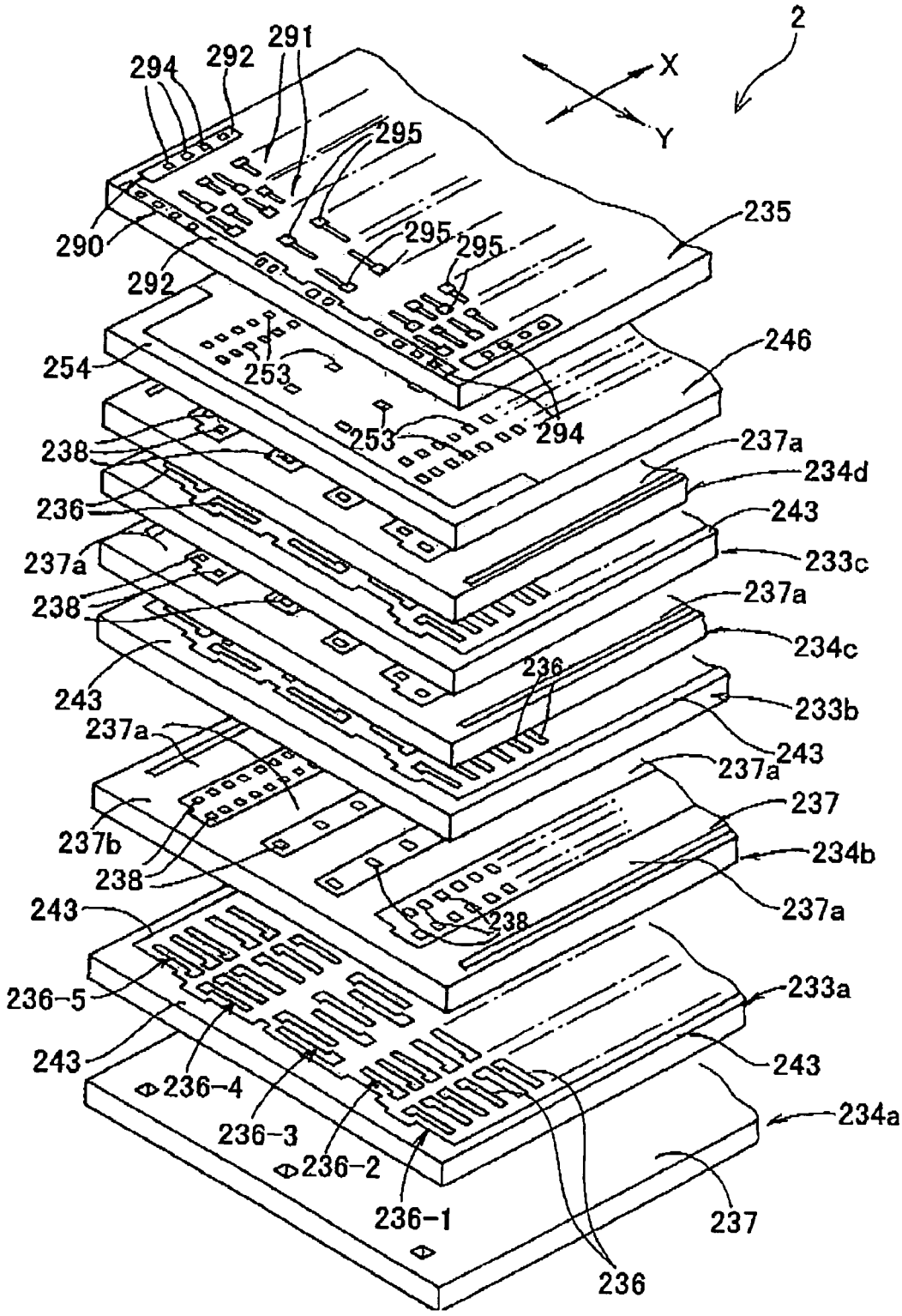
FIG. 5 shows an exploded perspective view of an actuator unit.
Figure 6:
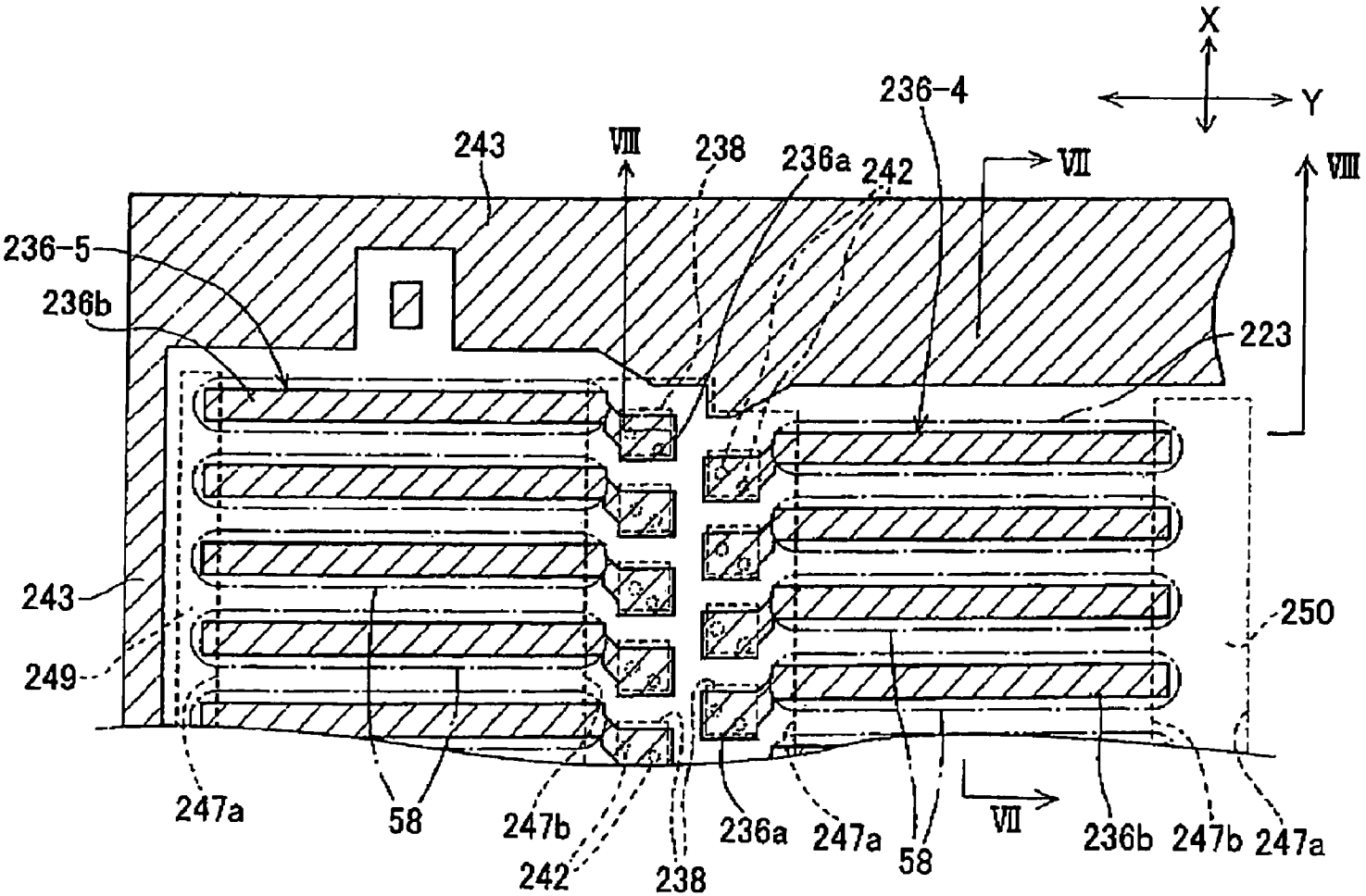
FIG. 6 shows a plan view of a portion of the actuator unit.
Figure 7:
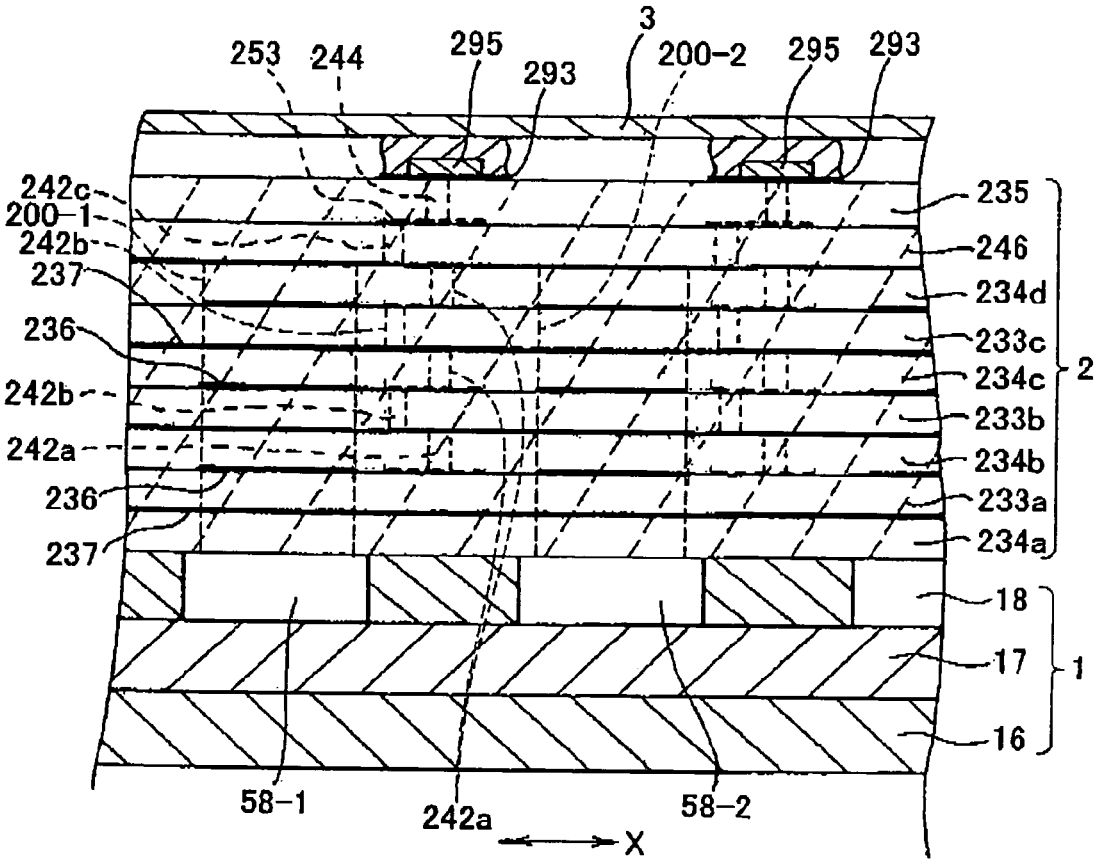
FIG. 7 shows a cross-sectional view along the line VII-VII of FIG. 6.

Next, the configuration of the actuator unit 2 will be described with reference to FIGS. 5 to 8. FIG. 5 is an exploded perspective view of the actuator unit 2. FIG. 6 is a plan view of a portion of the actuator unit 2, and is a figure for describing how separate electrodes and common electrodes overlap on a plan face. FIG. 7 is a cross-sectional view along the line VII-VII of FIG. 6, and FIG. 8 is a cross-sectional view along the line VIII-VIII of FIG. 6.

As will be described in detail later, the actuator unit 2 has a plurality of piezoelectric elements. When high voltage is applied between the separate electrodes and the common electrodes, piezoelectric sheets between the electrodes are polarized and consequently the thickness of the piezoelectric elements changes. The piezoelectric elements are provided with the same distribution and in the same numbers as the pressure chambers 58 of the cavity unit 1. This will be described in detail later.

As shown in FIG. 5, the actuator unit 2 has three separate electrode sheets 233*a*, 233*b*, and 233*c*, four common electrode sheets 234*a*, 234*b*, 234*c*, and 234*d*, an arresting layer sheet 246, and a top sheet 235. Each sheet has a thickness of approximately 30 (μm). The separate electrode sheets 233 and the common electrode sheets 234 are piezoelectric ceramic sheets. The arresting layer sheet 246 and the top sheet 235 may be piezoelectric ceramic sheets, or may be formed from other materials. It is preferred that the arresting layer sheet 246 and the top sheet 235 are electrically insulating.

The actuator unit 2 has the following stacked configuration sequentially from below: the common electrode sheet 234*a*, the separate electrode sheet 233*a*, the common electrode sheet 234*b*, the separate electrode sheet 233*b*, the common electrode sheet 234*c*, the separate electrode sheet 233*c*, the common electrode sheet 234*d*, the arresting layer sheet 246, and the top sheet 235.

The separate electrode sheet 233*a* is a piezoelectric ceramic sheet. Rows of separate electrodes 236-1, 236-2, 236-3, 236-4, and 236-5 are formed on upper face of the separate electrode sheet 233*a*. Each of rows of separate electrodes 236-1 to 236-5 is formed from a plurality of separate electrodes 236 aligned in the X direction. Rows of separate electrodes 236-1 to 236-5 are parallel in the Y direction. Each of the separate electrodes 236 corresponds to one of the pressure chambers 58 of the cavity unit 1. That is, each one of the separate electrodes 236 is located almost directly above one of the pressure chambers 58 of the cavity unit 1. That is, when the cavity unit 1 and the actuator unit 2 are viewed from a plan view, one separate electrode 236 overlaps with one pressure chamber 58. This is shown clearly in FIG. 6. A straight part 236*b* of each separate electrode 236 has approximately the same length as the pressure chamber 58 in the Y direction, and is slightly narrower than the pressure chamber 58 in the X direction. The separate electrodes 236 are formed by screen printing on the upper face of the separate electrode sheet 233*a*.

An end part 236*a* (a terminal) of each separate electrode 236 is bent slightly from the straight part 236*b*. Viewed from a plan view, the end parts 236*a* do not overlap with the pressure chambers 58.

Furthermore, a dummy common electrode 243 is formed along an outer periphery of the separate electrode sheet 233*a* (see FIG. 5). The dummy common electrode 243 is located so as to overlap, when viewed from a plan view, with common electrodes 237 of the common electrode sheets 234 (to be described).

The separate electrode sheet 233*b* has the same configuration as the separate electrode sheet 233*a*. Further, the separate electrode sheet 233*c* has the same configuration as the separate electrode sheet 233*a*.

The common electrode 237 is formed across almost the entirety of an upper face of the common electrode sheet 234*a*, which is the lowest layer shown in FIG. 5. The common electrodes 237 are formed, following a predetermined pattern, on the common electrode sheets 234*b*, 234*c*, and 234*c* that are disposed above the common electrode sheet 234*a*. The common electrodes 237 are formed by screen printing.

The common electrode 237 of the common electrode sheet 234*b* has first electric conducting parts 237*a* that overlap, when viewed from a plan view, with rows of the separate electrodes 236-1 to 236-5. The first electric conducting parts 237*a* extend in the X direction. The first electric conducting parts 237*a* have five rows (the same number as the rows of the separate electrode 236).

Moreover, the common electrode 237 of the common electrode sheet 234*b* has two second electric conducting parts 237*b* that connect with both ends of the first electric conducting parts 237*a*.

Additionally, the reference numbers 247*a* and 247*b* in FIG. 6 refer to a boundary line in the Y direction of the first electric conducting parts 237*a*.

As shown in FIG. 6, an area 249 onto which conductive paste has not been pressed (a blank portion) is formed on an upper face of the common electrodes sheet 234*b*. Further, an area 250, into parts of which conductive paste 238 has been pressed, is formed between the first electric conducting parts 237*a*. Below, the conductive paste 238 of the area 250 will be termed dummy separate electrodes. These dummy separate electrodes 238 are located so as to overlap, when viewed from a plan view, with the terminals 236*a* of the separate electrodes 236. The number of dummy separate electrodes 238 formed on the common electrode sheet 234*b* is the same as the number of separate electrodes 236 formed on the separate electrode sheet 233*a*.

The boundary lines 247*a* and 247*b* are boundary lines between the first electric conducting parts 237*a* and the aforementioned areas 249 and 250.

The common electrode sheets 234*c* and 234*d* have an identical configuration with the separate electrode sheet 233*b*, and a detailed description thereof is omitted.

When the separate electrode sheets 233*a* to 233*c* and the common electrode sheets 234*a* to 234*d* are stacked, the separate electrodes 236 and the first electric conducting parts 237*a* overlap. Both ends of the separate electrodes 236 in the Y direction protrude outwards further than the boundary lines 247*a* and 247*b* of the first electric conducting parts 237*a*. The length of piezoelectric elements (to be described) in the Y direction is determined by the dimension between the pair of boundary lines 247*a* and 247*b*.

As is clear from FIG. 5, a plurality of conductive patterns 253, which are almost square when viewed from a plan view, are formed on an upper face of the arresting layer sheet 246. Each one of the conductive patterns 253 is disposed so as to overlap with at least a part of one of the dummy separate electrodes 238 of the common electrode sheet 234*d*. Further, a conductive pattern 254 is formed on the upper face of the arresting layer sheet 246. The conductive pattern 254 is disposed so as to overlap, when viewed from a plan view, with a portion of the common electrodes 237 of the common electrode sheets 234*a* to 234*d*, and to overlap with a portion of the dummy common electrodes 243 of the separate electrode sheets 233*a* to 233*c*.

A plurality of conductive members (not shown) are formed at the second electric conducting parts 237*b* of the common electrode sheets 234*b* to 234*d* and pass through the common electrode sheets 234*b* to 234*d* in their direction of thickness (an up-down direction). Furthermore, a plurality of conductive members (not shown) are formed at the dummy common electrodes 243 of the separate electrode sheets 233*a* to 233*c*, and pass through the separate electrode sheets 233*a* to 233*c* in an up-down direction. A conductive member (not shown) is formed at the conductive pattern 254 of the arresting layer sheet 246, and passes through the arresting layer sheet 246 in an up-down direction. By this means, the second electric conducting parts 237*b* of the common electrode sheets 234*a* to 234*d* (and additionally the lowest common electrode 237), the dummy common electrodes 243 of the separate electrode sheets 233*a* to 233*c*, and the conductive pattern 254 of the arresting layer sheet 246 are electrically connected.

Conductive members 242*b* (see FIG. 7) are formed at the end parts 236*a* (see FIG. 6) of the separate electrodes 236 of the separate electrode sheets 233*b* and 233*c*, and pass through the separate electrode sheets 233*b* and 233*c* in an up-down direction. Conductive members 242*a* are formed at the dummy separate electrodes 238 of the common electrode sheets 234*b* to 234*d*, and pass through the common electrode sheets 234*b* to 234*d* in an up-down direction. Conductive members 242*c* are formed at the conductive patterns 253 of the arresting layer sheet 246, and pass through the arresting layer sheet 246 in an up-down direction. The separate electrodes 236, the dummy separate electrodes 238 corresponding to the separate electrodes 236, and the conductive patterns 253 corresponding to the dummy separate electrodes 238 are all electrically connected by the conductive members 242*a*, 242*b*, and 242*c*.

As shown in FIGS. 5 and 7, a connecting terminal 290 is formed at an upper face of the top sheet 235. The connecting terminal 290 is connected with a bumped electrode (not shown) used for connection with a common electrode at a lower face of the flat cable 3. Furthermore, a connecting terminal 291 is also formed at an upper face of the top sheet 235. The connecting terminal 290 is connected with a bumped electrode (not shown) used for connection with a separate electrode of the flat cable 3.

The connecting terminal 290 has a thin surface electrode 292, and a tick outer electrode 294 formed on a top surface of the surface electrode 292. Moreover, the connecting terminal 291 has a thin surface electrode 293 (see FIG. 7), and a thick outer electrode 295 formed on a top surface of the surface electrode 293.

A plurality of conductive members 244 (see FIGS. 7 and 8) are formed in the top sheet 235 and pass therethrough in an up-down direction. By this means, the connecting terminal 290 of the top sheet 235 and the conductive pattern 254 of the arresting layer sheet 246 are electrically connected. Further, the connecting terminal 291 of the top sheet 235 and the conductive pattern 253 of the arresting layer sheet 246 are electrically connected.

The surface electrode 292 of the connecting terminal 290 is disposed so as to overlap, when viewed from a plan view, with at least a part of the conductive pattern 254 of the arresting layer sheet 246. The outer electrode 294 is subsequently attached to the top surface of the surface electrode 292.

The surface electrodes 292 and 293, the separate electrodes 236, the common electrodes 237, the dummy separate electrodes 238, the dummy common electrodes 243, the conductive members 242 and 244, the conductive pattern 253, and the conductive pattern 254 are each formed by screen printing a top surface of a green sheet using a silver-palladium conductive material (conductive paste). Each of the aforementioned electrodes, which have been formed by screen printing, are stacked on the sheets 233, 234, 235, and 236, and are then annealed.

Since the silver-palladium conducting material has a high melting point, it does not evaporate even during high temperatures while the green sheet is being annealed.

The outer electrodes 294 and 295 are printed using silver-glass flit conductive paste after the annealing process has been performed. Further, annealing is performed at a lower temperature than the annealing described above.

The silver-glass flit conductive material has a lower melting point than the silver-palladium conductive material, but joins more satisfactorily with solder alloy. The connecting terminals 290 and 291 connect better with the bumped electrodes of the flat cable 3 than in the case where the outer electrodes 294 and 295 are not provided.

A high voltage for causing polarization is applied between all the separate electrodes 236 and the common electrodes 237 of the actuator unit 2. Parts between the separate electrodes 236 and the common electrodes 237 are polarized. By this means, the parts of the sheets 233 and 234 which are between the separate electrodes 236 and the common electrodes 237 are activated. The part represented by the reference number 200-1 in FIG. 7 becomes one piezoelectric element, and the part represented by the reference number 200-2 also becomes one piezoelectric element. That is, one piezoelectric element 200 is formed from three sheets of overlapping separate electrodes 236. As a result, the number of piezoelectric elements 200 is the same as the number of pressure chambers 58 in the cavity unit 1. One pressure chamber 58 is located directly below one piezoelectric element 200. In FIG. 7, for example, a pressure chamber 58-1 is located directly below the piezoelectric element 200-1, and a pressure chamber 58-2 is located directly below the piezoelectric element 200-2.

In the present embodiment, when voltage is applied between all the separate electrodes 236 and the common electrodes 237, an electric field is generated in a direction of polarization and this causes the piezoelectric elements to expand in an up-down direction. That is, the volume of each pressure chamber 58 is decreased. From this state, if the supply of voltage to selected separate electrodes 236 is terminated (when the content to be printed so requires), the piezoelectric elements 200 that correspond to the selected separate electrodes 236 are contracted. Therefore, the volume of the pressure chambers 58 that correspond to the selected separate electrodes 236 increases (the pressure in the pressure chambers 58 is reduced). In this case, the ink flows from the ink chamber 120 into the pressure chamber 58, via the intake hole 76*b*, the groove 76*a*, the discharge hole 76*c*, and the second BP hole 67 (see FIG. 8). Next, voltage is applied to the selected separate electrodes 236. In this case, the selected piezoelectric elements 200 expand, and therefore pressure is applied to the ink that has been filled into the selected pressure chambers 58 (the pressure in the pressure chambers 58 is increased). Thereupon, the ink flows through the first BP hole 57, SL hole 56, the second MP hole 55, the first MP hole 54, the DP hole 53, and the SP hole 52, and is discharged from the selected nozzles 51.

When a positive pressure wave, which was generated by increasing the pressure of the pressure chamber 58, has propagated to the nozzle 51, the pressure wave reverses to form a negative pressure wave which is reflected towards the pressure chamber 58. If the application of voltage to the separate electrode 236 is terminated at the time when the negative pressure wave arrives at the pressure chamber 58, there is an overlap between the reduction of pressure of the pressure chamber 58 due to the actuator unit 2 and the arrival of the negative pressure wave. A large amount of negative pressure will consequently be obtained, and the ink will be drawn effectively into the pressure chamber 58. The time between increasing the pressure of the pressure chamber 58 and the return to the pressure chamber 58 of the reflected negative pressure wave is approximately identical with the one-way propagation period. This is because, as described above, the pressure chamber 58 is disposed in an approximately central location between the ink chamber 120 and the nozzle 51.

When a negative pressure wave, which was generated by reducing the pressure of the pressure chamber 58, has propagated to the restrictor 76*a*, the pressure wave reverses to form a positive pressure wave which is reflected towards the pressure chamber 58. If voltage is applied to the separate electrode 236 at the time when the positive pressure wave arrives at the pressure chamber 58, there is an overlap between the increase of the pressure of the pressure chamber 58 due to the actuator unit 2 and the arrival of the reflected positive pressure wave. A large amount of positive pressure will consequently be obtained, and the ink will be discharged effectively from the pressure chamber 58. The time between reducing the pressure of the pressure chamber 58 and the return to the pressure chamber 58 of the reflected positive pressure wave is approximately identical with the one-way propagation period. This is because the pressure chamber 58 is disposed in an approximately central location between the ink chamber 120 and the nozzle 51.

Pressure can be increased effectively in the pressure chamber 58 in the following manner. That is, the pressure of the pressure chamber 58 is increased after elapsing the one-way propagation period from the decrease of the pressure in the pressure chamber 58. Further, pressure can be reduced effectively in the pressure chamber 58 in the following manner. That is, the pressure is reduced in the pressure chamber 58 after elapsing the one-way propagation period from the increase of the pressure in the pressure chamber 58. If this is repeated, resonance phenomena of the pressure wave are magnified. That is, the processes are repeated of increasing the pressure in the pressure chamber 58 after the pressure of the pressure chamber 58 has been reduced and the one-way propagation period has elapsed, and of reducing the pressure of the pressure chamber 58 after the pressure of the pressure chamber 58 has been increased and the one-way propagation period has elapsed. By this means, resonance phenomena are magnified, and ink is discharged more rapidly at a second pass than at a first pass, is discharged more rapidly at a third pass than at the second pass, and is discharged more rapidly at a fourth pass than at the third pass.

In the present embodiment, four ink droplets are discharged to print one dot on the sheet to be printed. Since the ink is discharged faster when the latter pass is discharged, the points of impact of the ink on the sheet can be close together even though the ink is being discharged four separate times onto paper that is moving continuously. Minute dots can be printed even though there are four separate discharges of ink.

Figure 9:
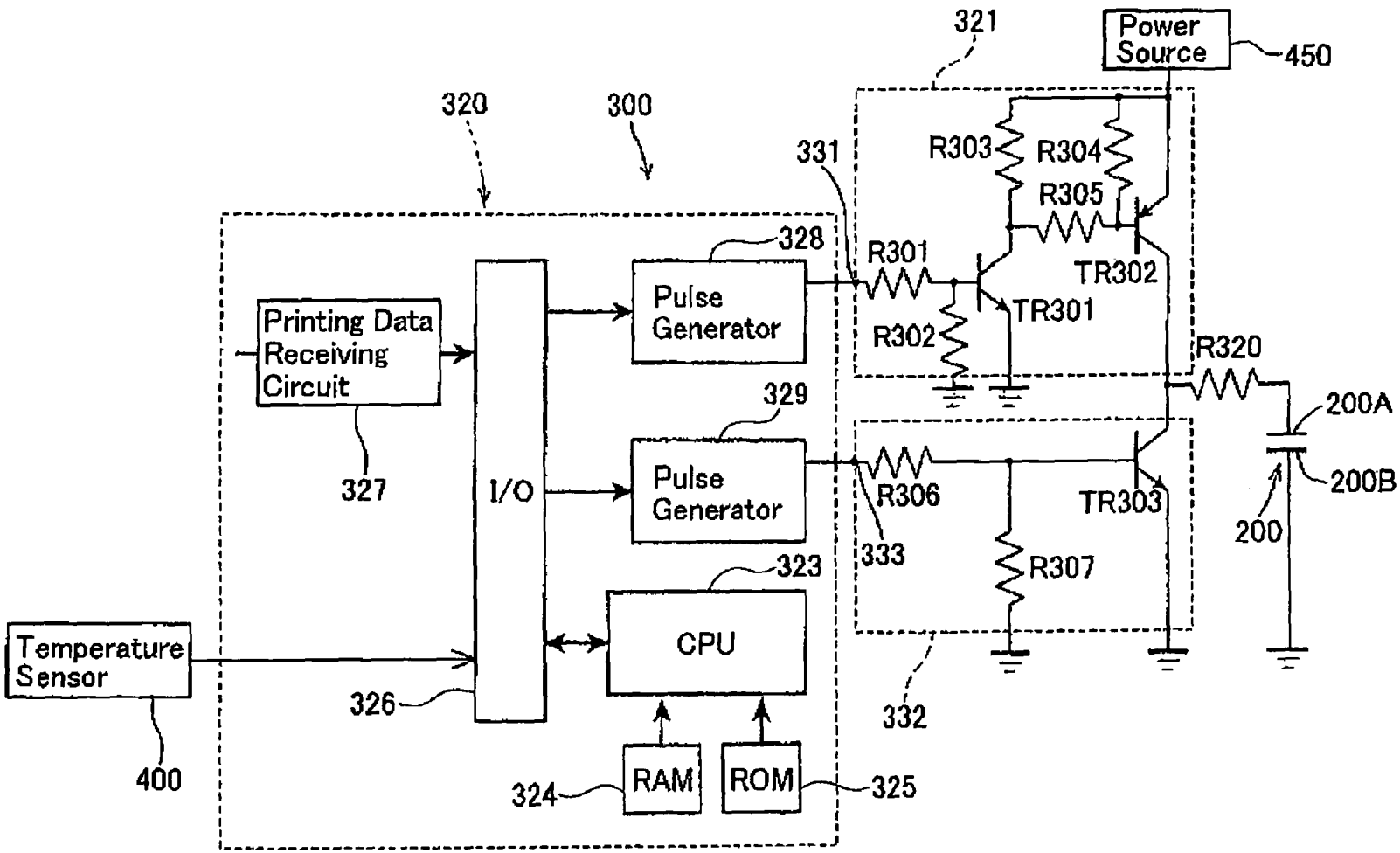
FIG. 9 shows a block diagram of a controller.

Next, the configuration of the controller 300, which controls the ink jet head 100, will be described with reference to FIG. 9. FIG. 9 is a block diagram of the controller 300. The controller 300 has a pulse controlling circuit 320, a charging circuit 321, and a discharging circuit 322. Each piezoelectric element 200 of the actuator unit 2 is represented as a condenser 200. Furthermore, the reference numbers 200A and 200B refer to condenser electrodes, and the reference number 450 refers to a positive power source.

The pulse controlling circuit 320 comprises a CPU 323, a RAM 324, a ROM 325, an I/O interface 326, a printing data receiving circuit 327, a pulse generator 328, and a pulse generator 329, etc.

The RAM 324 and the ROM 325 are connected with the CPU 323. The CPU 323 performs processing by using programs stored in the ROM 325. The RAM 324 temporarily stores printing data, other types of data, etc. The ROM 325 stores sequence data and a control program of the pulse controlling circuit 320. The ROM 325 is provided with an area for storing an ink discharge control program and an area for storing wave-form data of pulse signals (to be described). The following are included among the programs stored in the area for storing the ink discharge control program: a program whereby the CPU 323 determines the temperature region of a temperature measure by a temperature sensor 400 (i.e. a low temperature region, a normal temperature region, or a high temper region), and a program allowing the CPU 323 to select, on the basis of the above determination, values of a pulse width Ta and a pulse interval Wa. The following are included among the programs stored in the area of the ROM 325 for storing the wave-form data of pulse signals: the sequence data of the pulse signals, and the pulse width Ta and the pulse interval Wa that correlate to each of the temperature regions (the low temperature region, the normal temperature region, and the high temperature region).

The I/O 326 is connected with the CPU 323, the printing data receiving circuit 327, the temperature sensor 400, the pulse generator 328, and the pulse generator 329. The I/O 326 is capable of communicating with the CPU 323. Information output from the printing data receiving circuit 327 and the temperature sensor 400 is input to the I/O 326. The I/O 326 outputs information to the pulse generators 328 and 329.

The printing data receiving circuit 327 receives data (hereafter termed printing data) concerning the content to be printed by the printer 1000. The printing data is output by hardware connected with the printer 1000. For example, in the case where the printer 1000 is connected with a computer, the printing data is output by the computer.

The pulse generator 328 generates pulses to be input to the charging circuit 321 (to be described). The pulse generator 329 generates pulses to be input to the discharging circuit 322 (to be described). The CPU 323 processes the printing data and causes the pulse generator 328 and the pulse generator 329 to generate pulses that have a timing that will print dots. The CPU 323 controls the pulse generator 328 and the pulse generator 329 based on the sequence data stored in the area of the ROM 325 for storing the wave-form data of pulse signals. The pulse generator 328 is connected with an input terminal 331 of the charging circuit 321, and the pulse generator 329 is connected with an input terminal 333 of the discharging circuit 322.

The temperature sensor 400 detects the temperature surrounding the ink jet printer 1 (the surrounding temperature). The temperature data determined by the temperature sensor 400 is fetched to the CPU 323 via the I/O 326.

The charging circuit 321 is provided with resistors R301, R302, R303, R304, and R305, and transistors TR301 and TR302, etc. The manner in which each element is connected is shown clearly in FIG. 9. As a result, the connection of each element is not described in detail here.

When an on signal (+5V) is input to the input terminal 331, the transistor TR301 turns to conducting state. Thereupon, current from the positive power source 450 flows, via the resistor R303, from a corrector of the transistor TR301 towards an emitter thereof. There is an increase in the potential of the voltage of the resistors R304 and R305 connected with the positive power source 450. There is an increase in the current flowing to a base of the transistor TR302. Conduction then occurs between an emitter and a corrector of the transistor TR302. Voltage (20V) from the positive power source 450 is applied to the condenser 200 via the transistor TR302 and the resistor R320. An electric load corresponding to this piezoelectric capacitance is therefore accumulated in the two terminals 200A and 200B of the condenser 200.

The discharging circuit 322 is provided with resistors R306, and R307, a transistor TR303, etc. The manner in which each element is connected is shown clearly in FIG. 9. As a result, the connection of each element is not described in detail here.

When an on signal (+5V) is input to the input terminal 333, this is applied to the transistor TR303. As a result, the transistor TR303 turns to conducting state. The terminal 200A of the condenser 200 is earthed.

In FIG. 9, there is only one pulse generator 328, pulse generator 329, charging circuit 321, and discharging circuit 322. However, the number of pulse generators 328, pulse generators 329, charging circuits 321, and discharging circuits 322 is identical with the number of condensers 200 (That is, the piezoelectric element 200). That is, there is the same number of these elements as the number of nozzles 51. It is determined which of the pulse generators, 328 or 329, will be used based on the printing data received by the printing data receiving circuit 327.

Figure 10:
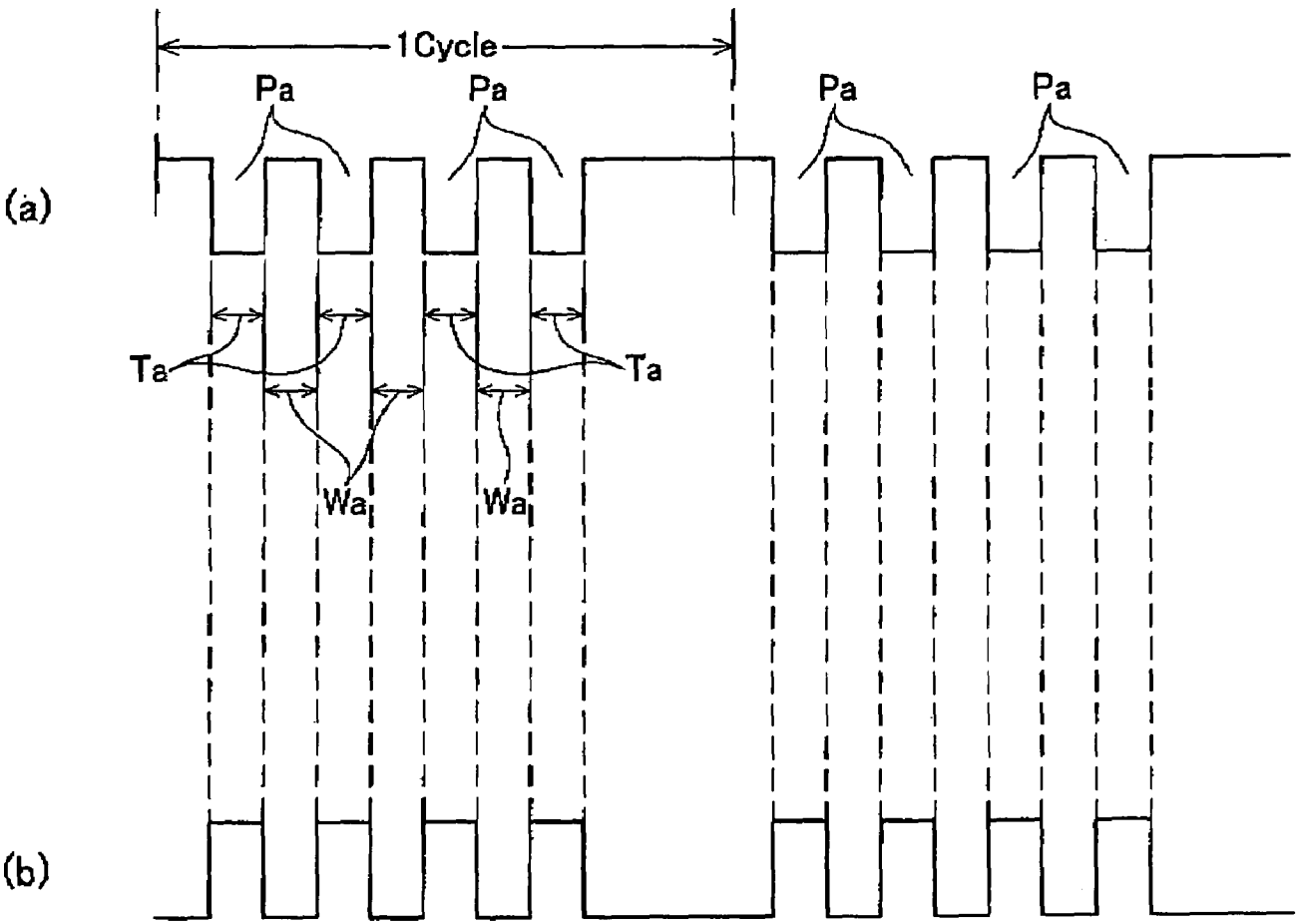
FIG. 10 (*a*) shows pulse signals for charging generated by a pulse generator.

Next, the pulses generated by the pulse generators 328 and 329 will be described. FIG. 10 (*a*) shows an example of pulses generated by the pulse generator 328. In the ink jet printer 1000 of the present embodiment, four ink droplets are discharged to print one dot. In the present embodiment, four pulses Pa are generated to discharge these four droplets. The amplitude of each of the four pulses Pa is identical (20V, for example). The pulse width Ta of each of the four pulses Pa is identical. The raise interval Wa (the interval from a rise position of a first pulse Pa to a fall position of a subsequent Pa) of two adjacent pulses Pa is identical with the pulse width Ta (That is, Wa=Ta).

FIG. 10 (*b*) shows an example of pulses generated by the pulse generator 329. The pulses generated by the pulse generator 329 are the inverse of the pulses generated by the pulse generator 328. That is, when the pulses of the pulse generator 328 fall (go from ON to OFF), the pulses of the pulse generator 329 rise (go from OFF to ON). Further, when the pulses of the pulse generator 328 rise (go from OFF to ON), the pulses of the pulse generator 329 fall (go from ON to OFF). Therefore, the pulse width Ta of the pulse generator 328 is identical with the pulse interval of the pulse generator 329, and the pulse interval Wa of the pulse generator 328 is identical with the pulse width of the pulse generator 329. As a result, the pulse interval of the pulse generator 328, the pulse width of the pulse generator 328, the pulse interval of the pulse generator 329, and the pulse width of the pulse generator 329 are identical.

The wave-form data storage area of the ROM 325 (see FIG. 9) stores correlations between temperature area and pulse width. That is, a correlation is stored between 'below 15° C.' and 'pulse width TL'. It also stores a correlation between '15° C. or above and below 30° C.' and 'pulse width TR'. It further stores a correlation between '30° C. or above' and 'pulse width TH'. This information is used when the CPU 323 determines which pulse width will be used. This point will be described in detail later.

The operation of the controller 300 of the present embodiment will now be described. The printing data receiving circuit 327 receives printing data. The received printing data is fetched to the CPU 323 via the I/O 326. The CPU 323 selects which of the condensers 200 to drive on the basis of the printing data that has been fetched. That is, the CPU 323 selects the pulse generators 328 and 329 which correspond to the condensers 200 to be driven.

Next, the CPU 323 fetches the temperature detected by the temperature sensor 400. When the CPU 323 has fetched the temperature, it selects the pulse width that corresponds to this temperature. That is, in the case where the temperature is below 15° C., the pulse width TL is selected. In the case where the temperature is 15° C. or above and below 30° C., the pulse width TR is selected, and in the case where the temperature is 30° C. or above, the pulse width TH is selected.

When the CPU 323 has selected the pulse generators 328 and 329 and the pulse width, it controls the selected pulse generators 328 and 329 such that the selected pulse width will be achieved. That is, the pulse generator 328 is controlled so that it generates pulses of the selected pulse width (this being the same as the pulse interval). Similarly, the pulse generator 329 is controlled so that it generates pulses of the selected pulse width (this being the same as the pulse interval). At this time, the pulse generators 328 and 329 are controlled so that they generate inverse (non-overlapping) pulses.

Consider, for example, the case where temperature is 20° C. and the pulse width TR has been selected. In this case, the pulse generator 328 is controlled so that it outputs pulses with a pulse width TR and a pulse interval TR. The pulse generator 329 is controlled so that it outputs pulses with a pulse width TR and a pulse interval TR.

With this type of control, the timing is such that a first pulse of the pulse generator 328 is a falling pulse, and the first pulse of the pulse generator 329 is a rising pulse. At this time, the piezoelectric element 200 is discharged and the volume of the pressure chamber 58 increases. The ink of the ink chamber 120 therefore flows into the pressure chamber 58. Next, after TR has elapsed, wherein the first pulse of the pulse generator 328 falls (and the first pulse of the pulse generator 329 rises), the pulse of the pulse generator 328 rises, and the pulse of the pulse generator 329 falls. The piezoelectric element 200 is thus charged and the volume of the pressure chamber 58 decreases. When pressure is applied to the ink that has been filled into the pressure chamber 58, this ink is discharged from the nozzle 51. Next, TR elapses, wherein the pulse of the pulse generator 328 rises (and the pulse of the pulse generator 329 falls), and then the pulse of the pulse generator 328 falls, and the pulse of the pulse generator 329 rises. This pulse generation process is repeated until the pulse generators 328 and 329 have output four pulse signals. Four droplets of ink are thus discharged, and one dot is thus printed.

Next is a description as to how the pulse intervals TL, TR, and TH stored in the ROM 325 are set.

The time AL (the one-way propagation period) for the pressure wave applied to the ink to propagate from the ink chamber 120 to the nozzle 51 varies in accordance with factors such as the degree of resistance at the time the ink is flowing, the viscosity of the ink, and the rigidity (or degree of vertical elasticity) of the sheets 11 to 18, etc. The one-way propagation period AL is particularly affected by the viscosity of the ink. Usually, ink viscosity tends to be reduced at high temperatures and to be increased at low temperatures.

Moreover, the distance from the center of the pressure chamber 58 to the ink chamber 120 is approximately identical with the distance from the center of the pressure chamber 58 to the nozzle 51. In other words, it could be said that the one-way propagation period is the time taken for the pressure wave, which was generated in the pressure chamber 58, to be reflected and to return to the ink chamber 120 after it had reached the ink chamber 120 (or more precisely, the restrictor 76*a*).

In the present embodiment, if the surrounding temperature of the ink jet printer 1000 is in the low temperature region (below 15° C.), the period adopted is $AL_L$=5.5 (μs) (microseconds). If the surrounding temperature is in the normal temperature region (in the range of 15° C. to 30° C.), the period adopted is $AL_R$=5.4 (μs). If the surrounding temperature is in the high temperature region (30° C. or above), the period adopted is $AL_H$=5.2 (μs). These values are obtained by using a computer to analyze actual ink flow. Since the method whereby the computer analyzes ink flow is commonly known, it is not described in detail here.

In the case where the pulse width Ta and the pulse interval Wa of the pulse signal Pa have been made to accord with the one-way propagation period AL of each surrounding temperature of the ink jet printer 1000, the piezoelectric element 200 car increase the pressure of the ink with maximum efficiency. When ink pressure is increased efficiently, a relatively large quantity of ink is discharged. Ink density is comparatively stable when a large quantity of ink is set to be discharged. However, the present inventor has found through tests that it is not possible to stabilize printing density even when the piezoelectric elements 200 are set to constantly discharge ink with optimum efficiency. The quantity of ink discharged differs when the temperature of the ink is high and the ink is discharged with optimum efficiency versus when the temperature of the ink is low and the ink is discharged with optimum efficiency. It is not possible to stabilize printing density merely by causing the pulse width Ta and the pulse interval Wa of the pulse signal Pa to accord with the one-way propagation period AL of each surrounding temperature of the ink jet printer 1000. Although discharging ink with optimum efficiency tends to stabilize printing density, it is not sufficient.

The present inventor performed experiments to obtain the pulse width Ta and the pulse interval Wa whereby, in varying surrounding temperatures, pressure is increased efficiently by the piezoelectric elements 200 and printing density is stabilized. The pulse width Ta and the pulse interval Wa of the pulse signal Pa (i.e. TL, TR, and TH) are expressed by one-way propagation periods $AL_H$, $AL_R$, $AL_L$, and corresponding coefficients by which these are multiplied. That is, TH is expressed by a value obtained by multiplying $AL_H$ by a coefficient αH. TL is expressed by a value obtained by multiplying $AL_L$ by a coefficient αL. TR is expressed by a value obtained by multiplying $AL_R$ by a coefficient αR.

FIG. 11 shows the results of the tests performed to determine the aforementioned coefficients (αH, αR, and αL). These tests show the results obtained when printing was performed while varying the value of Ta (=Wa) in three surrounding temperatures. A pulse signal with a 20 kHz cycle was used in these tests. Furthermore, individual dots were disposed on a print medium in a matrix format, and the printing density was measured of a printed image wherein ink was applied evenly over a wide area. O represents errors within ±5% with respect to adequate density. A triangle represents errors within ±10% with respect to adequate density. X represents errors above ±10% with respect to adequate density.

The following can be understood from these test results:

In low surrounding temperatures, the following is preferred; $0.90\ AL_L < Ta\ (=Wa) < 1.40\ AL_L$. In normal surrounding temperatures, the following is preferred; $0.80\ AL_R < Ta\ (=Wa) < 1.10\ AL_R$. In high surrounding temperatures, the following is preferred; $0.60\ AL_H < Ta\ (=Wa) < 0.90\ AL_H$.

That is, it is preferred that αH is a range from 0.60 to 0.90. It is preferred that αR is a range from 0.80 to 1.10. It is preferred that αL is a range from 0.90 to 1.40.

Furthermore, the following is further preferred in low surrounding temperatures; $1.1\ AL_L < Ta\ (=Wa) < 1.40\ AL_L$. The following is further preferred in normal surrounding temperatures; $0.80\ AL_R < Ta\ (=Wa) < 1.10\ AL_R$. The following is further preferred in high surrounding temperatures; $0.60\ AL_H < Ta\ (=Wa) < 0.80\ AL_H$.

In the present embodiment, TL is $1.20\ AL_L$. TH is $0.70\ AL_H$. TR is $1.00\ AL_R$.

As described above, the ink jet printer 1000 uses TL as the pulse width and the pulse interval in the case where the temperature detected by the temperature sensor 400 is below 15° C. In the case where the temperature detected by the temperature sensor 400 is 15° C. or above and below 30° C., TR is used as the pulse width and the pulse interval. In the case where the temperature detected by the temperature sensor 400 is 30° C. or above, TH is used as the pulse width and the pulse interval.

In the present embodiment, 1.20 is adopted as αL, 1.00 is adopted as αR, and 0.70 is adopted as αH. That is, TL is 6.6 (μs) (5.5×1.2), TR is 5.4 (μs) (5.4×1.00), and TH is 3.64 (μs) (5.2×0.7).

These settings ensure that the quantity of ink for one dot is suitable irrespective of whether the surrounding temperature is high, normal, or low. Printing density is constant, and image quality can be stabilized.

In the embodiment described above, four pulse signals Pa are used to print one dot. However, a number of pulse signals other than four can be used to print one dot. The technique of the present embodiment can be adopted even for ink jet printers that use only one pulse signal.

In the embodiment described above, temperatures were divided into three temperature regions. However, temperatures may equally well be divided into two temperature regions. For example, a pulse width T1 may be adopted in the case where the ink temperature exceeds a predetermined value, and a pulse width T2 may be adopted in the case where the ink temperature is below the predetermined value. Printing density can be stabilized using this method.

Figure 12:
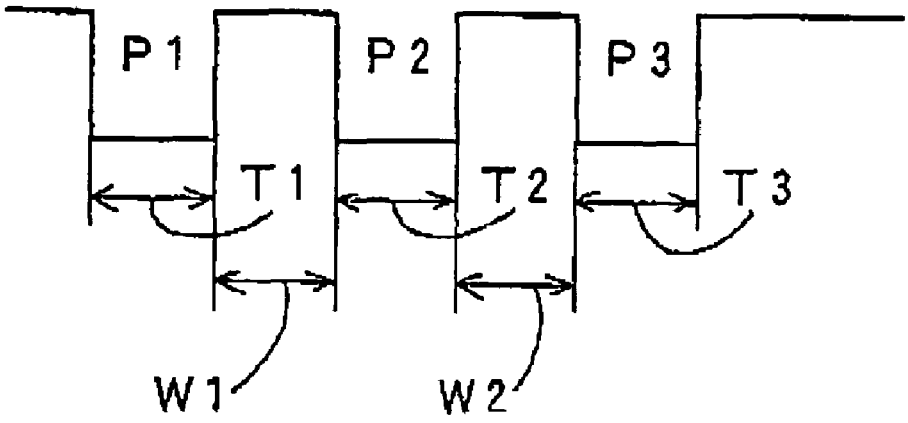
FIG. 12 shows pulse signals of another embodiment.

Further, the pulse width of consecutive pulses may be varied. For example, as shown in FIG. 12, T1 and T2 may be differing values, and T2 and T3 may be differing values.

Moreover, the pulse interval of consecutive pulses way be varied. For example, W1 and W2 in FIG. 12 may be differing values.

The pulse width and the pulse interval may have mutually differing values. For example, T1 and W1 in FIG. 12 may have mutually differing values, and W1 and T2 may have mutually differing values.

The temperature sensor 400 in the present embodiment detects the temperature of the surroundings of the ink jet printer 1000. However, a temperature sensor may equally well be disposed within the ink chamber 120, and this temperature sensor may directly measure the temperature of the ink. Further, this temperature sensor may indirectly measure the temperature of the ink by measuring the temperature of walls that demarcate the ink chamber 120.

A temperature sensor may measure the temperature of the ink directly or indirectly. As described above, an outside air temperature sensor may be used Otherwise, it is preferred that a temperature sensor for measuring a temperature of the ink in the ink chamber is adopted. It is also preferred that a temperature sensor for measuring a temperature of a wall of an ink passage is adopted.

In the embodiment described above, the puke signal which causes a first change of voltage applied to the piezoelectric element to decrease pressure in the pressure chamber and a second change of voltage to increase pressure in the pressure chamber is used. Instead of the pulse signal, a pulse signal which causes a first change to increase pressure in the pressure chamber and a second change to decrease pressure in the pressure chamber may be used.

What is claimed is:

1. An ink jet printer comprising:

an ink chamber;

a nozzle connected with the ink chamber;

a pressure chamber located between the ink chamber and the nozzle;

a piezoelectric element facing the pressure chamber;

a temperature sensor for measuring at least one of a temperature of ink and a surrounding temperature of the ink jet printer; and a controller programmed to perform a first change of voltage applied to the piezoelectric element and a second change of voltage applied to the piezoelectric element and to change a period between the first change and the second change based on the temperature measured by the temperature sensor, wherein the controller adopts a short period when the temperature is high, and the controller adopts a long period when the temperature is low the controller adopts a first period when the temperature is higher than a first predetermined temperature, the controller adopts a third period when the temperature is lower than a second predetermined temperature, the first period is shorter than the third period, and the first predetermined temperature is higher than the second predetermined temperature.

2. The ink jet printer as in claim 1, wherein the controller comprises a pulse generator that generates a pulse signal to the piezoelectric element to cause discharge of an ink droplet from the nozzle, the first change is performed when a level of the pulse signal changes from a first level to a second level, the second change is performed when the level of the pulse signal changes from the second level to the first level, and the pulse generator generates the pulse signal having a pulse width that corresponds to the period changed based on the temperature.

3. The ink jet printer as in claim 1, wherein the first period is within a range between $0.6\times AL_H$ and $0.9\times AL_H$, the third period is within a range between $0.9\times AL_L$ and $1.4\times AL_L$, $AL_H$ is a time taken for a pressure wave within the ink to propagate from the ink chamber to the nozzle when the temperature is higher than the first predetermined temperature, and $AL_L$ is a time taken for the pressure wave to propagate from the ink chamber to the nozzle when the temperature is lower than the second predetermined temperature.

4. The ink jet printer as in claim 1, wherein the controller adopts a second period when the temperature is between the first predetermined temperature and the second predetermined temperature, the first period is shorter than the second period, and the second period is shorter than the third period.

5. The ink jet printer as in claim 4, wherein the first period is within a range between $0.6\times AL_H$ and $0.9\times AL_H$, the second period is within a range between $0.8\times AL_R$ and $1.1\times AL_R$, the third period is within a range between $0.9\times AL_L$ and $1.4\times AL_L$, $AL_H$ is a time taken for a pressure wave within the ink to propagate from the ink chamber to the nozzle when the temperature is higher than the first predetermined temperature, $AL_R$ is a time taken for the pressure wave to propagate from the ink chamber to the nozzle when the temperature is between the first predetermined temperature and the second predetermined temperature, and $AL_L$ is a time taken for the pressure wave to propagate from the ink chamber to the nozzle when the temperature is lower than the second predetermined temperature.

6. The ink jet printer as in claim 1, wherein the controller is programmed to perform the first change to decrease pressure in the pressure chamber and the second change to increase pressure in the pressure chamber.

7. The ink jet printer as in claim 1, wherein the controller is programmed to repeatedly perform the first change and the second change so that a plurality of droplets of the ink is discharged from the nozzle to substantially a same point of a print medium, and the controller is programmed to change a period from the first change to the second change and a period from the second change to the repeated first change based on the temperature.

8. An ink jet printer comprising:

an ink chamber;

a nozzle connected with the ink chamber;

a pressure chamber located between the ink chamber and the nozzle;

a piezoelectric element facing the pressure chamber;

a temperature sensor for measuring at least one of a temperature of ink and a surrounding temperature of the ink jet printer; and a controller programmed to perform a first change of voltage applied to the piezoelectric element and a second change of voltage applied to the piezoelectric element and to change a period between the first change and the second change based on the temperature measured by the temperature sensor, wherein the controller is programmed to repeatedly perform the first change and the second change so that a plurality of droplets of the ink is discharged from the nozzle to substantially a same point of a print medium, the controller is programmed to change a period from the first change to the second change and a period from the second change to the repeated first change based on the temperature, the period from the first change to the second change is equal to the period from the second change to the repeated first change, and the controller changes each of the periods based on the temperature.

9. The ink jet printer as in claim 8, wherein the controller adopts a short period when the temperature is high, and the controller adopts a long period when the temperature is low.

10. The ink jet printer as in claim 9, wherein the controller adopts a first period when the temperature is higher than a first predetermined temperature, the controller adopts a third period when the temperature is lower than a second predetermined temperature, the first period is shorter than the third period, and the first predetermined temperature is higher than the second predetermined temperature.

11. The ink jet printer as in claim 10, wherein the first period is within a range between $0.6\times AL_H$ and $0.9\times AL_H$, the third period is within a range between $0.9\times AL_L$ and $1.4\times AL_L$, $AL_H$ is a time taken for a pressure wave within the ink to propagate from the ink chamber to the nozzle when the temperature is higher than the first predetermined temperature, and $AL_L$ is a time taken for the pressure wave to propagate from the ink chamber to the nozzle when the temperature is lower than the second predetermined temperature.

12. The ink jet printer as in claim 10, wherein the controller adopts a second period when the temperature is between the first predetermined temperature and the second predetermined temperature, the first period is shorter than the second period, and the second period is shorter than the third period.

13. The ink jet printer as in claim 12, wherein the first period is within a range between $0.6\times AL_H$ and $0.9\times AL_H$, the second period is within a range between $0.8\times AL_R$ and $1.1\times AL_R$, the third period is within a range between $0.9\times AL_L$ and $1.4\times AL_L$, $AL_H$ is a time taken for a pressure wave within the ink to propagate from the ink chamber to the nozzle when the temperature is higher than the first predetermined temperature, $AL_R$ is a time taken for the pressure wave to propagate from the ink chamber to the nozzle when the temperature is between the first predetermined temperature and the second predetermined temperature, and $AL_L$ is a time taken for the pressure wave to propagate from the ink chamber to the nozzle when the temperature is lower than the second predetermined temperature.

14. A method for discharging ink from an ink jet printer, the ink jet printer comprising an ink chamber, a nozzle connected with the ink chamber, a pressure chamber located between the ink chamber and the nozzle, and a piezoelectric element facing the pressure chamber, the method comprising:

a step of performing a first change of voltage applied to the piezoelectric element and a second change of voltage applied to the piezoelectric element;

a step of measuring at least one of a temperature of the ink and a surrounding temperature of the ink jet printer; and a step of changing a period between the first change and the second change based on the temperature measured in the measuring step, wherein a short period is adopted in the changing step when the temperature is high, a long period is adopted in the changing step when the temperature is low, a first period is adopted in the changing step when the temperature is higher than a first predetermined temperature, a third period is adopted in the changing step when the temperature is lower than a second predetermined temperature, the first period is shorter than the third period, and the first predetermined temperature is higher than the second predetermined temperature.

15. The method as in claim 14, wherein the first period is within a range between $0.6\times AL_H$ and $0.9\times AL_H$, the third period is within a range between $0.9\times AL_L$ and $1.4\times AL_L$, $AL_H$ is a time taken for a pressure wave within the ink to propagate from the ink chamber to the nozzle when the temperature is higher than the first predetermined temperature, and $AL_L$ is a time taken for the pressure wave to propagate from the ink chamber to the nozzle when the temperature is lower than the second predetermined temperature.

16. The method as in claim 14, wherein a second period is adopted in the changing step when the temperature is between the first predetermined temperature and the second predetermined temperature, the first period is shorter than the second period, and the second period is shorter than the third period.

* * * * *